US005676209A

United States Patent [19]

Reynolds

[11] Patent Number: 5,676,209

[45] Date of Patent: Oct. 14, 1997

[54] DEEP WATER RISER ASSEMBLY

[75] Inventor: Graeme E. Reynolds, Houston, Tex.

[73] Assignee: Hydril Company, Houston, Tex.

[21] Appl. No.: 559,638

[22] Filed: Nov. 20, 1995

[51] Int. Cl.[6] ..... E21B 19/09

[52] U.S. Cl. ..... 166/345; 166/359

[58] Field of Search ..... 166/339, 340, 166/345, 352, 359; 405/195.1, 223.1

[56] References Cited

U.S. PATENT DOCUMENTS

| | | | |
|---|---|---|---|
| 3,259,198 | 7/1966 | Montgomery et al. | 175/7 |
| 3,554,277 | 1/1971 | Bauer et al. | 166/338 |
| 3,603,409 | 9/1971 | Watkins | 175/7 |
| 3,913,668 | 10/1975 | Todd et al. | 166/359 |
| 4,046,191 | 9/1977 | Neath | 166/352 |
| 4,063,602 | 12/1977 | Howell et al. | 175/7 |
| 4,081,039 | 3/1978 | Wardlow | 175/7 |
| 4,126,183 | 11/1978 | Walker | 166/338 |
| 4,170,266 | 10/1979 | Fayren | 175/7 |
| 4,448,266 | 5/1984 | Potts | 175/7 |
| 4,511,287 | 4/1985 | Horton | 405/204 |
| 4,616,707 | 10/1986 | Langner | 166/345 |
| 4,662,785 | 5/1987 | Gibb et al. | 405/195.1 |
| 4,813,495 | 3/1989 | Leach | 175/6 |
| 5,046,896 | 9/1991 | Cole | 405/195.1 |
| 5,147,148 | 9/1992 | White et al. | 405/199 |
| 5,421,676 | 6/1995 | Wybro et al. | 405/223.1 |

FOREIGN PATENT DOCUMENTS 1103400 2/1968 United Kingdom ..... E21B 41/00

OTHER PUBLICATIONS

Printed Publication No. 984 —*National Academy of Sciences—National Research Council*, Washington, D.C. 1962, pp. 114–121.

*National Science Foundation Project Mohole*. May 1966, pp. 2–32, 3–21, and 3–22, Drawing No. Data Sheet 2–1A, unidentified Drawing on the next page describing the report.

*Primary Examiner*—Frank Tsay

*Attorney, Agent, or Firm*—Vaden, Eickenroht & Thompson L.L.P.

[57] ABSTRACT

A deep water riser assembly includes a lower BOP stack positioned adjacent and anchored to the bottom of the ocean and an upper BOP stack attached to the riser at a water level just far enough below the surface to be unaffected by surface currents. The upper BOP stack has shear rams above the pipe rams to sever the section of the drill pipe above the shear rams to allow the upper section of the drill pipe between the shear rams and the drill ship to be retrieved followed by the section of riser above the upper BOP stack to free the drill ship to move as required to better weather a surface storm. A floatation module is attached to the riser below the upper BOP stack and exerts an upward force that holds the riser below the upper BOP stack free-standing and in tension. Means are provided to reconnect the upper section of the riser to the upper BOP stack after the storm has passed.

3 Claims, 4 Drawing Sheets

Figure 1:
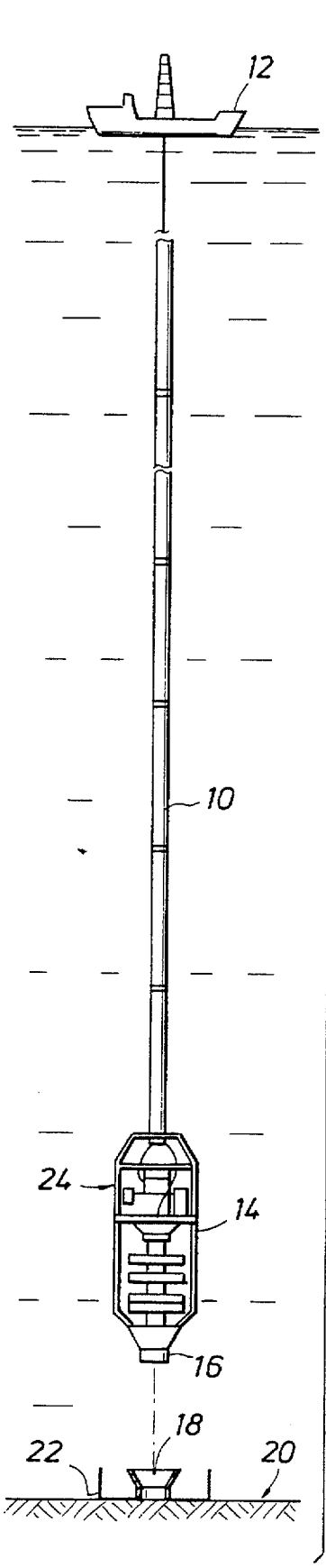

12
43
42
40
38
36
32
34
20

DEEP WATER RISER ASSEMBLY

This invention relates generally to risers that connect offshore drilling vessels to a blowout preventer stack (BOP) attached to the ocean bottom and in particular to risers in deep water, i.e., more than 5,000 ft. although the invention has utility in shallower waters.

A semi-submersible or drill ship operating, for example, in the Gulf of Mexico with several thousand feet of riser pipe extending between the ship and the ocean bottom is vulnerable to storms, such as the hurricanes that occur regularly in the Gulf during hurricane season. Presently, when a drill ship receives a hurricane warning, the riser, which is made up of joints of pipe connected together, is released from the BOP stack on the bottom and removed from the water joint by joint to free the ship to position itself to better ride out the storm.

Removing the riser takes time and the longer the riser, the more time it takes plus there is a limit to how many joints of riser pipe the drill ship can safely store.

Therefore, it is an object of this invention to provide apparatus for and a method of allowing a drill ship to remove only the upper portion of the riser that could be subjected to strong currents and that, if left floating, could result in the upper portion being bent sufficiently to cause the riser to fail.

It is a further object and feature of this invention to provide apparatus for and a method of allowing the drill ship to disconnect the upper section of a riser that would be vulnerable to surface currents and remove that section from the water thereby allowing the ship to weather the storm, and then reconnect the section removed to the portion of the riser left in the water.

It is a further object and feature of this invention to maintain the section left in the water more or less vertical and in tension so that section of the riser will not be damaged by being disconnected from the drill ship.

It is another object and feature of this invention to position an upper stack of blowout preventers in the riser at a level below the surface where lateral currents are minimal, attach a buoyancy module just below the upper stack to maintain the riser below the buoyancy module in tension and generally vertical after the riser above the upper stack is removed, and locate one or more reels of multiplex electrical cable adjacent the upper BOP stack with the reels having sufficient cable to accommodate varying lengths of riser between the upper and the lower BOP stack while maintaining the upper BOP stack a convenient distance below the surface.

It is another object and feature of this invention to provide a method of supporting a riser in a vertical position and in tension while the upper section of the riser is removed to allow the drill ship to ride out or avoid a surface storm, such as a hurricane. The method includes the steps of shearing the upper portion of the drill string, removing the upper portion of the drill string and the upper portion of the riser, riding out the storm, and reconnecting the upper portions of the drill string and the riser to the portions thereof left in the water.

These and other objects, advantages, and features of this invention will be apparent to those skilled in the art from a consideration of the specification, including the attached drawings and appended claims.

Figure 2:
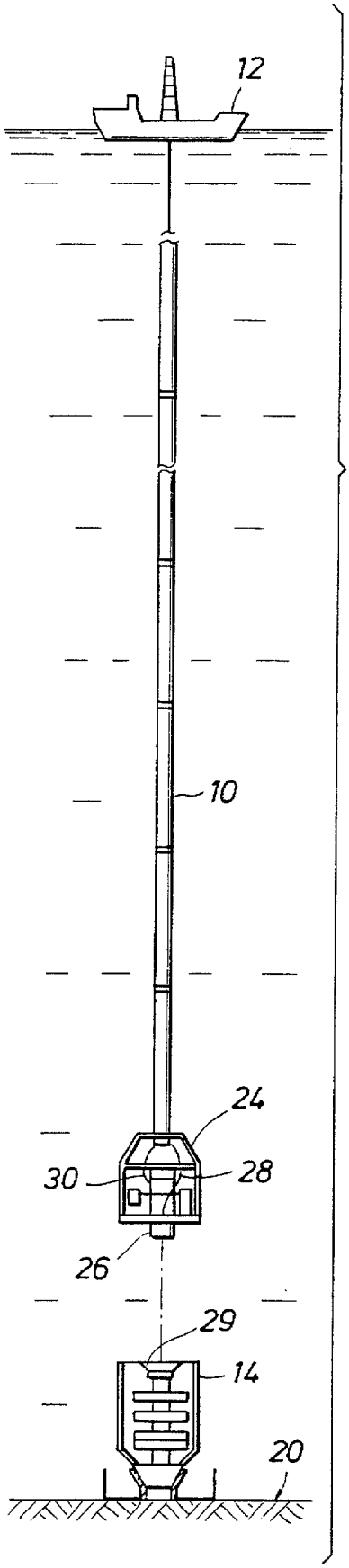

In the Figures:

FIGS. 1 and 2 illustrate the present manner in which risers are used. In FIG. 1, riser 10 that extends from drill ship 12 is in the process of lowering BOP stack 14 so that conically shaped latch guide 16 will engage funnel 18, which has been attached to a casing string that is cemented in bottom 20 of the body of water, and latch BOP stack 14 to funnel 18. In case of a storm, the blowout preventer stack generally stays connected to the bottom and only Lower Marine Riser Package (LMRP) 24 is disconnected and removed from the water along with the riser. After the storm has passed, the riser then will be rerun into the water with Lower Marine Riser Package 24, which has a connection 26 that engages funnel 28 on the BOP stack and latches the Lower Marine Riser Package to the lower BOP stack.

Kill and choke lines extend along the riser as shown in FIGS. 1 and 2 on the sides of the riser and through lines 28 and 30 on the lower riser package to supply power to kill the well and to flow the well to the surface during completion operations.

Generally, BOPs in deep water are operated by multiplex electronic signals from the surface which operate solenoid pilot valves that control hydraulic power fluid control valves that open and close the BOPs.

Figures 3, 4, 5:
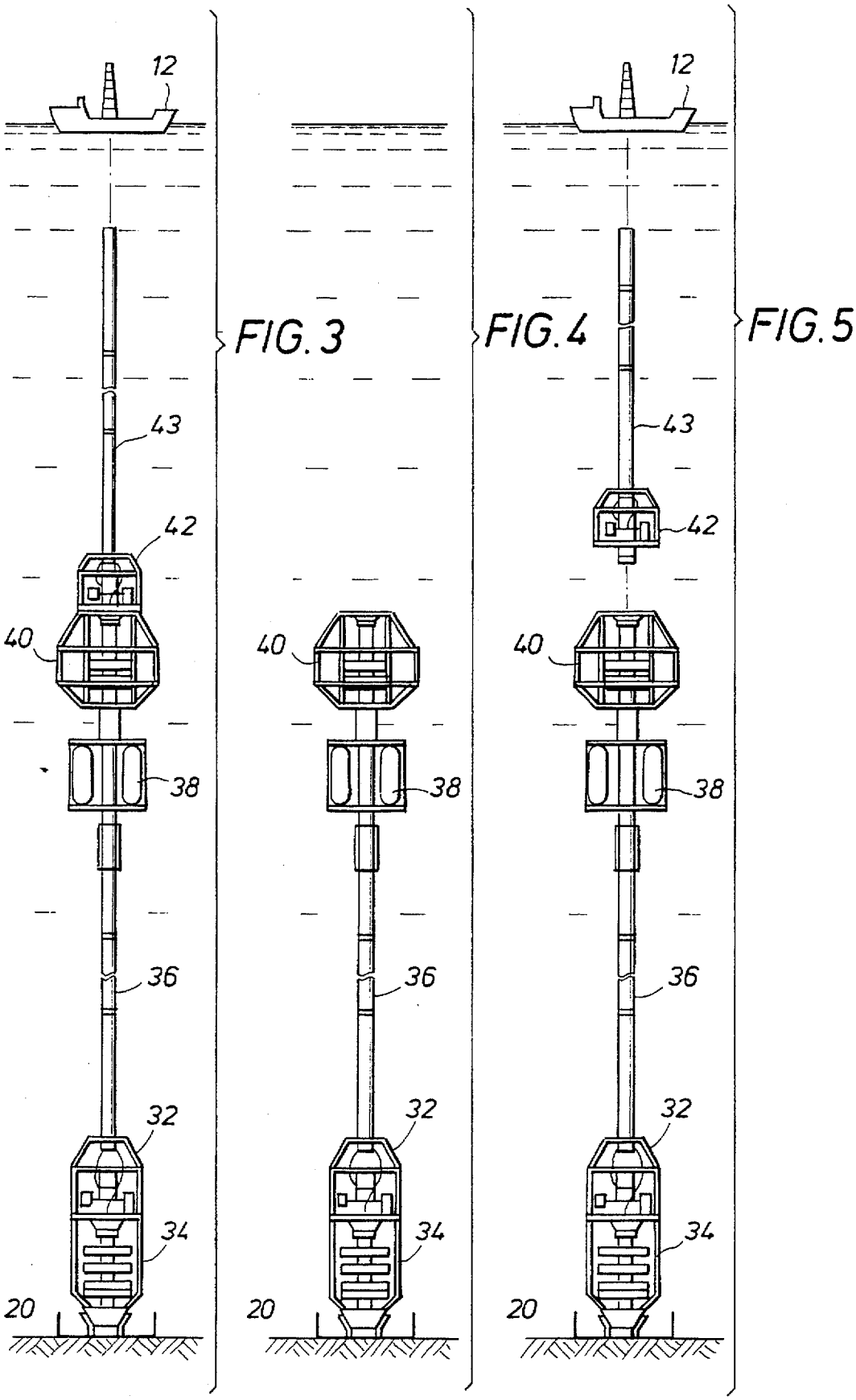

FIGS. 3, 4, and 5 illustrate the method and apparatus of this invention. In FIG. 3, Lower Marine Riser Package 32 is connected to lower BOP stack 34, which in turn is attached to the bottom, as explained in connection with FIGS. 1 and 2. The BOP stack is provided with electrical power through multiplex cables that extend to the Lower Marine Riser Package and is also connected to kill and flow lines that extend to the surface along the side of the riser. Portion 36 of the riser can extend for thousands of feet, for example, from the Lower Marine Riser Package 32 to floatation module 38. Above the floatation module is upper BOP stack 40 and Upper Marine Riser Package 42. Preferably the distance from the Upper Marine Riser Package and the surface of the water will be around 500 feet. This will make sure that the upper BOP stack is well below any destructive currents that may be flowing adjacent the surface of the water when the upper portion of the riser has been removed as shown in FIG. 4. Floatation module 38 maintains section 36 of the riser between the lower BOPs and upper BOP stack 40 in tension and generally vertical because the currents at this depth will not be great. After the storm has passed, drill ship 12 returns to the location, reassembles upper riser section 43 and lowers the Upper Marine Riser Package 42 back to be reconnected with upper BOP stack 40 and drilling can be resumed.

Figure 6:
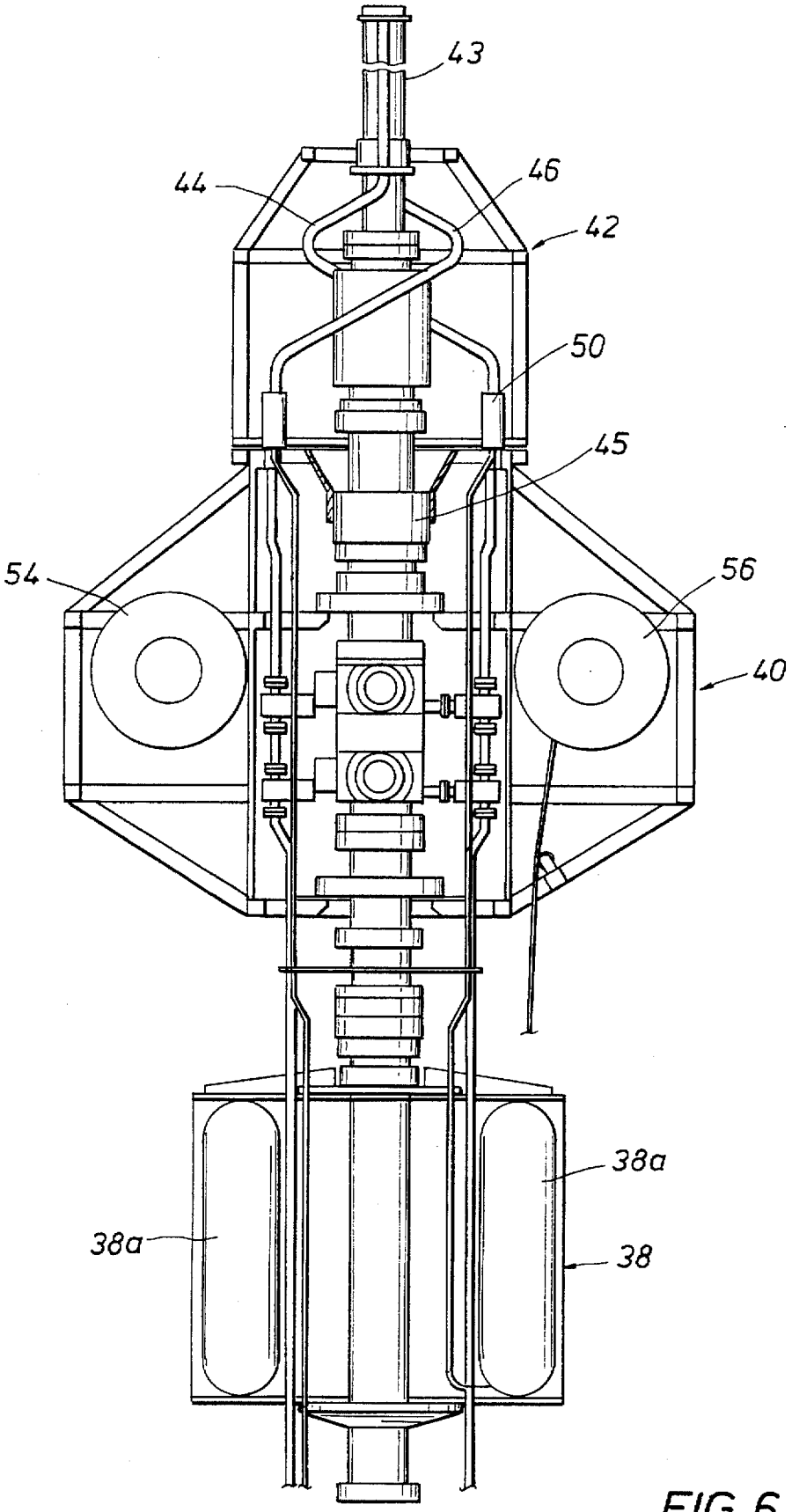

FIG. 6 is a view partially in section and partially in elevation of the Upper Marine Riser Package (UMRP) which includes emergency disconnect module 45. The UMRP is connected to upper BOP stack 40, and floatation module 38. As explained above, kill and flow lines 44 and 46 extend downwardly along upper riser section 43 through the Upper Marine Riser Package 42, through the upper BOP stack downwardly past the floatation module to the LMRP at the lower end of the riser. Hydraulically extending and retracting kill and flow line connectors 50 and hydraulically extend/retract wet make/break electro-connectors 52, as shown in FIG. 7, allow the electrical lines and the kill and choke lines to be connected and disconnected as the UMRP is disengaged and reconnected to the upper BOP stack.

One of the features of this invention, is to provide the upper BOP stack assembly with multiplex cable reels 54 and 56. These reels are provided with sufficient multiplex electrical cable to reach the LMRP attached to the lower BOP stack and supply electrical power to the lower BOP stack even though the length of the riser with which the upper BOP stack is associated, varies in length from one location to the other. With this arrangement then, it allows the upper section of the riser above the upper BOP stack to be removed as explained above to allow the drill ship to maneuver in the case of bad weather without disconnecting the electrical connection between the upper BOP stack and the lower BOP stack. Preferably, the riser string will be designed so that the upper BOP stack is generally always about 500 feet below the surface, which is a safe distance and yet a distance that allows the upper section of the riser pipe to be removed within a relatively short period of time so that the delay from the time a bad weather warning is received and the time the riser upper section is retrieved is not excessive.

Figure 7:
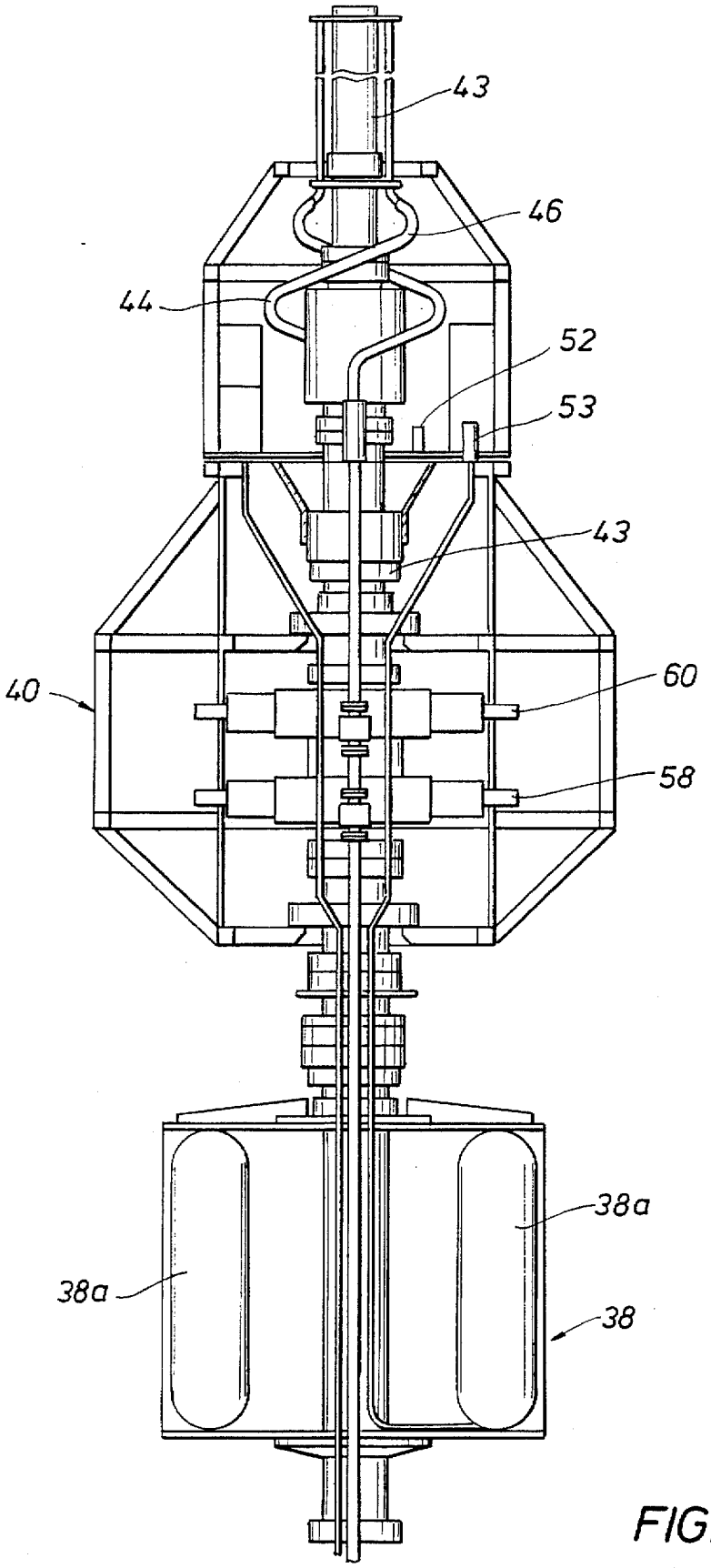

The floatation module contains a plurality of bladders 38*a* that can be inflated by air supplied from the surface from an air line that is connected to the upper BOP stack through hydraulic extend/retract air boost/mud boost connectors 53 as shown in FIG. 7.

The upper BOP stack has at least two BOPs. The upper BOP 60 is provided with shear rams, the lower BOP 58 will be equipped with pipe rams that will engage the drill pipe below the shear ram BOP and hold the upper BOP and floatation modules in position on the portion of the riser and drill pipe left in the water. The shear rams are used to sever the drill pipe and release the upper portion of the drill pipe so that it can be removed from the water also.

After the storm passes and the upper portion of the riser and the UMRP is rerun the drill pipe is used to attach an overshot to, the severed portion of the drill pipe joint. The drill pipe is pulled, the severed joint replaced, and the drill pipe is run back into the hole.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A deep water riser assembly extending between a drill ship and the bottom of the water through which drill pipe extends to rotate a drill bit and drill a well bore in the bottom below the water, said riser assembly comprising a lower BOP stack positioned adjacent and anchored to the bottom of the water, a lower section of riser pipe joints extending upwardly from the lower BOP stack, an upper BOP stack attached to the lower section of the riser at a water level far enough below the surface to be unaffected by surface currents, said upper BOP stack having lower pipe rams to engage the drill pipe and seal the annulus between the upper BOP stack and the riser, and an upper section of riser pipe joints extending upwardly from the upper BOP stack, shear rams in the upper BOP stack above the pipe rams to sever the portion of the drill pipe above the shear rams to allow the upper section of the drill pipe between the shear rams and the drill ship to be retrieved and disconnecting and removing the upper section of riser pipe to free the drill ship to move as required to better weather a surface stem, and a floatation module attached to the riser below the upper BOP stack to exert an upward force of the riser below the upper BOP and hold the riser below the upper BOP free-standing in tension, and means to reconnect the upper section of the riser to the upper BOP stack after the storm has passed.

2. The deep water riser assembly of claim 1 in which the lower BOP are opened and closed by electrical motors, two reels of electrical conduit mounted on the upper BOP having sufficient cable to extend to the lower BOP stack and supply power to the lower BOP to open and close the rams of the BOP's.

3. The deep water riser assembly of claim 2 further provided with kill and flow lines and electrical conductors having upper portions that extend from the drill ship to the upper BOP stack and lower portions that extend from the upper BOP stack to the lower BOP stack, kill and flow line connectors mounted on the upper BOP stack for connecting the upper and lower portions of the kill and flow lines and connectors mounted on the upper BOP stack for connecting the upper and lower portions of the electrical conductors to allow the upper portions of the kill and flow lines and the upper portion of the electrical conductors to be disconnected from their lower portions and raised to the surface with the upper portion of the riser.

* * * * *